US005947831A

United States Patent [19]

McCarthy

[11] Patent Number: 5,947,831

[45] Date of Patent: Sep. 7, 1999

[54] TARGET FOR GOLF PRACTICE

[76] Inventor: Charles J. McCarthy, 13234 Margate St., Sherman Oaks, Calif. 91401

[21] Appl. No.: 08/917,953

[22] Filed: Aug. 27, 1997

[51] Int. Cl.[6] ..... A63B 69/36

[52] U.S. Cl. ..... 473/197

[58] Field of Search ..... 473/197, 190, 473/191, 194, 195, 172; 273/181 F, 400, 401

[56] References Cited

U.S. PATENT DOCUMENTS

| | | | |
|---|---|---|---|
| 3,758,116 | 9/1973 | Pieronek | 273/400 |
| 3,918,711 | 11/1975 | Zak | 473/197 |
| 3,986,719 | 10/1976 | Lee | 473/197 |
| 4,326,717 | 4/1982 | McClimon | 473/197 |
| 4,643,423 | 2/1987 | Wright | 473/197 |
| 5,452,896 | 9/1995 | Core | 473/197 |

FOREIGN PATENT DOCUMENTS

| | | | |
|---|---|---|---|
| 934599 | 8/1963 | United Kingdom | 273/181 F |

*Primary Examiner*—Mark S. Graham

*Attorney, Agent, or Firm*—Roger A. Marrs

[57] ABSTRACT

A portable target is disclosed having a net of wide mesh with an opening smaller than a golf ball and with upper and lower edges. A target representation is disposed in the center of the net at which a golf ball is intended to be driven during a practice stroke. The upper edge includes a plurality of snap-type hooks engageable with a support rod so that the net downwardly depends from the rod. End fittings releasably secure the opposite ends of the support rod to a garage door or to a garage door frame so that the net occupies the opening in the frame when the door is moved to its overhead open position. The lower edge includes a collection trough for collecting the golf ball after striking the net and resilient elements are releasably connected between the net and the garage frame for tensioning the net whereby the target is taut and in place.

6 Claims, 1 Drawing Sheet

TARGET FOR GOLF PRACTICE

BACKGROUND OF THE INVENTION

1. Field of the Invention

The present invention relates to the field concerning the game of golf, and more particularly toga novel target for use in practicing the game of golf with respect to a player's improving his driving skills.

2. Brief Description of the Prior Art

In the past, a variety of teaching aids and practice devices have been employed for improving a golfer's game of golf. One such accessory for improving a golfer's driving skills is to use a net which is placed a short distance away from a spot where the golfer intends to drive a golf ball. Upon swinging the club and hitting the ball, the ball will be stopped by the net and the golfer has no difficulty in retrieving the ball. Therefore, the golfer can concentrate on his swing and the striking of the ball without concern for aiming. The advantage of using nets placed on portable stanchions is that the nets may be placed indoors or outdoors and may include secondary nets at the rear in order to stop golf shots which top the net. Usually, the nets are composed of a strong, heavy duty nylon and allow for a full swing practice in the user's back yard or in the garage.

Problems and difficulties have been encountered with such conventional nets which stem largely from the fact that an elaborate stanchion or hold-down mechanism is required for maintaining the net in position as well as maintaining the net taut so that it will stop the ball upon impact. Also, the sides of the net are sometimes loose so that the net will rise or "fly" when impacted by the ball and the ball will roll away from the net causing the golfer to have difficulty in collecting a plurality of balls after his practice. Such conventional nets are manufactured and sold by the Wilson Company, having model numers 220-000 and model 341-003.

Other problems have been encountered because the aiming feature is not considered. The nets are usually of a square or rectangular shape and there is a lack of target or selected area intended to be most favorably impacted by the golf ball. Therefore, although the golfer can practice his driving swing, which includes power technique, his aiming skill is neglected when using the conventional netting. Also, the conventional netting avoids a means for collecting the balls after they have impacted the net so that it is convenient for the user to gather the balls at the close of a practice session.

Therefore, a long-standing need has existed to provide a novel practice device having a target area against which impacting balls driven by a golfer can be stopped and which includes features for collecting the balls so that the golfer's practice need not be interrupted for retrieval. Preferably, the device may take the form of a net having a central target area and which includes a collection trough or box at its base into which spent balls are gathered and available for subsequent collection.

SUMMARY OF THE INVENTION

Accordingly, the above problems and difficulties are avoided by the present invention which includes a portable target comprising a net of wide mesh having a plurality of openings which are smaller than the diameter of a golf ball. The net includes an upper edge and a lower edge with a target representation disposed midway between the upper and lower edges and between the sides of the net which communicate the opposite ends of the edges. The target representation is intended to receive the impact of a golf ball which is driven by a golfer during a practice session. The upper edge of the net includes a plurality of releasable hooks engageable with a support rod so that the net downwardly depends from the rod. End fittings are releasably secured to the opposite ends of the support rod for detachable mounting to a garage door or to a garage door frame whereby the net occupies the opening in the garage door frame when the door is moved to its overhead open position. The lower edge of the net includes a collection means which may take the form of a trough or box for collecting the golf balls after striking the net. Resilient elements are detachably connected between the garage door frame and the side edges of the net for tensioning the net whereby the target is taut and remains in place after each impact of a driven ball.

Therefore, it is among the primary objects of the present invention to provide a novel practice device for the game of golf which includes a net having a target at which a driver may aim his ball during a full swing of a golf club at practice.

Another object of the present invention is to provide a net having a central target for use in the practice of the play of golf wherein the net may be detachably suspended across the opening in a garage door frame when the garage door has been raised.

Another object of the present invention is to provide a targeted net intended to be impacted by a golf ball and which further includes a collection means for the ball after impact so that a plurality of balls may be subsequently collected or gathered.

A further object of the present invention is to provide a relatively inexpensive accessory for installation across the opening of a garage door frame when the garage door is up and which provides a target for a golfer during a practice stroke when driving a golf ball.

Yet a further object of the present invention is to provide a means for improving a golfer's aim during a full swing of a golf club by providing a target for the golf ball which may be carried on the garage door itself and deployed as the door is opened or which may be detachably connected to the garage frame when the garage door is open.

BRIEF DESCRIPTION OF THE DRAWINGS

The features of the present invention which are believed to be novel are set forth with particularity to the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
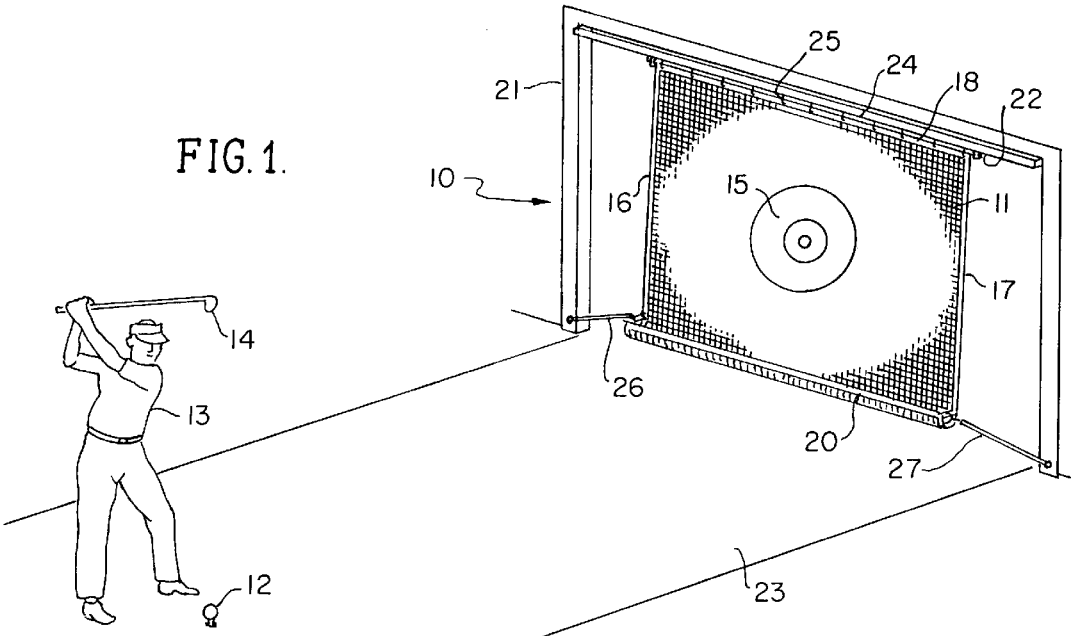
FIG. 1 is a perspective view showing the novel target for golf practice incorporating the present invention.

Referring to FIG. 1, the novel target for use in the practice of golf is indicated in the general direction of arrow 10. The device includes a netting 11 composed of a mesh material, such as nylon or the like, which has a plurality of openings of smaller dimension than the diameter of a golf ball. A typical golf ball is indicated by numeral 12 and it is intended that a golfer 13 strike the ball 12 with a golf club 14 in order to drive the ball into the net 11. A major feature of the invention is the inclusion of a target 15 carried on the mesh of net 11 which is in the center of the net midway between opposite sides 16 and 17 as well as between a top edge 18 and a lower edge 20. A target 15 may be a graphic representation, such as a bull's-eye, or may be a represenation of an animal or other graphic representation. The target may be a separate sheet carried on the front face of the neeting 11 or it may be a material which is impregnated into the net itself. In some instances, the target may be detachably connected to the front face of the netting.

An important feature of the invention is that the netting and target are portable so that the device may be readily attached or detached from either a garage door frame 21 or the edge of a garage door, such as indicated by numeral 22. When in operation, the garage door is raised inside of the garage so that a substantial opening appears between the uprights and the crossmember of the frame 21. A paved area 23 is conventionally placed ahead of the garage so that a vehicle can be passed along the pavement 23 into and out of the garage opening when the door is raised. The present invention is detachably installed in the opening by means of a support rod 24 from which the top edge 18 of the netting 11 downwardly depends. A plurality of releasable fasteners 25 hold the upper edge of the netting to the support rod. The lower edge 20 is folded over in place in front of the front face of the netting so that a trough is provided whereby balls impacting against the netting will subsequenstly drop into the trough for collection so that the plurality of balls collected may be gathered and returned to a player for reuse. The netting is held taut by means of resilient members 26 and 27 that place a tension on the netting by anchoring the opposite ends of the resilient elements to the side edges of the netting and the garage door frame 21.

Figure 2:
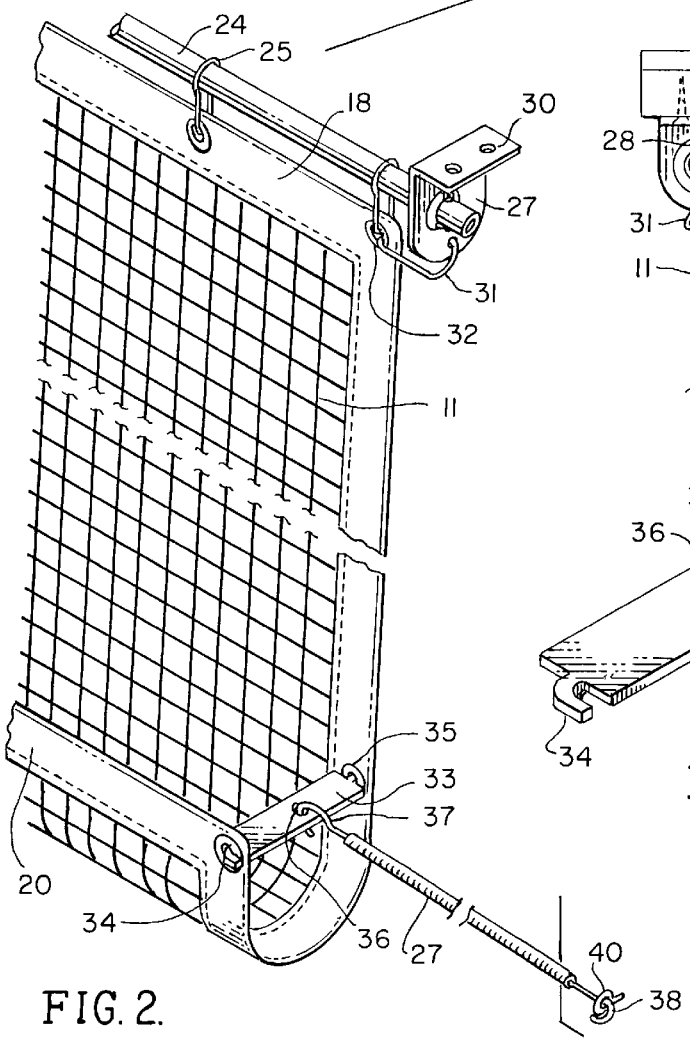
FIG. 2 is an enlarged fragmentary view of the device illustrated in FIG. 1.
Figure 3:
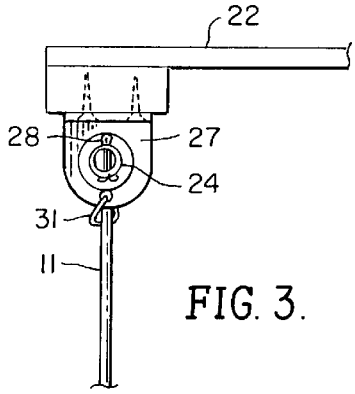
FIG. 3 is a side elevational view of the attachment means for the fitting holding the support rod to a garage door frame or to the garage door itself.

Referring to FIG. 2 in detail, it can be seen that the ends of the support rod 24 are detachably connected to a fixture at each end, such as fixture 27. Each fixture includes an aperture or opening for receiving the extreme end of rod 24 through which a retention pin 28 may be placed, as shown more clearly in FIG. 3. The fixture 27 may include a flange 30 that may be screwed to a cross-member of the garage frame 21 or to a cross-member carried on the door 22. The installation is selected by the user. In order to place a tension on the upper portion of the netting, and particularly along the upper edge 18, a retaining clip 31 is provided having one end releasably attached to the fitting 27 and its opposite end attached to a grommet 32 carried on the netting at its corner. The grommet 32 is similar to the grommets placed along the edge 18 through which the clips 25 are placed.

FIG. 2 also illustrates the creation of a trough at the bottom of the netting when the edge 20 is folded forward of the netting so as to be opposed in fixed spaced-apart relationship with respect to the front face thereof. The maintenance of the spaced-apart relationship is provided by spacer 33 that is attached by hooks at its opposite ends to grommets 34 and 35 carried along the edge of the netting. A central opening 36 is provided in the spacer 33 for detachably receiving with a hook 37 provided on one end of the resilient element 27. The opposite end of the element includes a hook 38 that is detachably coupled with an eyelet 40 connected to the garage frame 21. In this fashion, the spacer 33 maintains the trough open so that balls will drop into the trough after impacting against the netting. A tension is provided on the netting to maintain the netting taut at its lower end by the resiliency of the element 27. The element may take the form of a helical coil spring which is normally biased in a contracting manner so as to pull the lower part of the net towards the lower part of the garage door frame.

Figure 4:
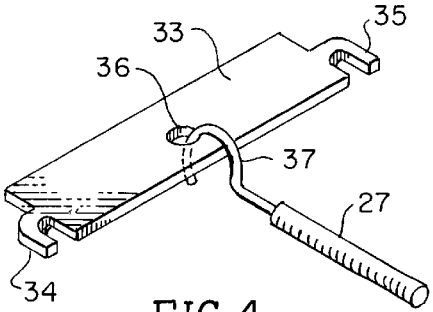
FIG. 4 is an enlarged perspective view showing a tensioning means for maintaining the net of the device taut.

Referring now in detail to FIG. 4, the spacer 33 is illustrated having integrally formed hooks or anchors 34 and 35 formed or carried on its opposite ends. The hole 36 insertably receives the hook 37 for releasable attachment for one end of the resilient element 27.

In view of the foregoing, it can be seen that the golfer 13 may set his golf ball 12 on a tee on the pavement 23 preparatory for striking the ball during a practice driving procedure. The golfer then addresses the ball and raises the club to the position shown in FIG. 1 at which time the downward swing brings the head of the club into contact with the ball 12 which drives the ball forward towards the netting 11. The golfer may take aim with respect to the target 15 and as the ball 12 strikes the target or the netting, a visual observation tells the golfer how good his aim is. Also, once the ball has impacted against the front face of the netting 11, the shock is absorbed by the netting and the ball will drop into the trough defined by the front face of the netting and the folded-over edge 20 of the netting. The trough is maintained open by means of the spacers 33 on each end and the netting is maintained taut by the clips 31 and the resilient members of elements 27.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A target apparatus for use in the practice of a game of golf comprising:

a net of wide mesh having a plurality of openings smaller than the diameter of a golf ball;

said net having an upper edge marginal region and a lower edge marginal region separating a central midsection;

a target representation carried on said central midsection of said net between said upper edge marginal region and said lower edge marginal region;

said target representation adapted to forcibly receive the impact of a golf ball driven during the practice procedure;

means carried on said upper edge marginal region for suspending said net to expose said target representation;

means disposed on said lower edge marginal region for collecting golf balls after impacting said net;

said suspension means includes a plurality of detachable fasteners arranged in fixed spaced-apart relationship;

said collection means includes a portion of said lower edge marginal region being turned up upon itself to define an open-ended trough across the length of said net; and adjustable tensioning means detachably disposed on opposite ends of said trough for tensioning said net whereby said target representation is taut and in place after impact.

2. The target apparatus defined in claim 1 wherein:

said net is elongated having side edge marginal regions separated by said central midsection and connecting said upper edge marginal region with said lower edge marginal region.

3. The target apparatus defined in claim 2 including:

an elongated mounting rod having opposite ends; and mounting fixtures carried on said mounting rod opposite ends.

4. The target apparatus defined in claim 3 wherein:

said tensioning means includes a spacer bar at each end of said trough and a spring detachably carried on each of said bars.

5. The target apparatus defined in claim 4 including:

a frame defining a central opening;

said net downwardly depending from said frame across said frame opening; and said tensioning means extending between said net and said frame.

6. The target apparatus defined in claim 5 wherein:

said target representation is in spaced-apart relationship with respect to a practice golfer and is in full view of the golfer.

* * * * *